United States Patent [19]

Adamski et al.

[11] Patent Number: 4,528,922

[45] Date of Patent: Jul. 16, 1985

[54] GUIDANCE SYSTEM FOR A WORKPIECE TRANSFER APPARATUS

[75] Inventors: Maximillian Adamski, Wheeling; David C. Jenkins, Mount Prospect; Robert L. Kosrow, Hoffman Estates, all of Ill.

[73] Assignee: Union Special Corporation, Chicago, Ill.

[21] Appl. No.: 603,875

[22] Filed: Apr. 25, 1984

Related U.S. Application Data

[62] Division of Ser. No. 545,804, Oct. 26, 1983, abandoned.

[51] Int. Cl.[3] ..... D05B 97/00

[52] U.S. Cl. ..... 112/262.3

[58] Field of Search ..... 112/262.3, 262.1, 121.12, 112/121.11, 121.15, 308, 309, 304, 141, 147, 153

[56] References Cited

U.S. PATENT DOCUMENTS

| | | | |
|---|---|---|---|
| 3,965,831 | 1/1978 | Weir | 112/121.29 X |
| 4,003,323 | 1/1977 | Crawford et al. | 112/141 |
| 4,066,025 | 1/1978 | Speer | 112/147 X |
| 4,067,277 | 6/1976 | Solomon et al. | 112/121.29 X |
| 4,428,315 | 1/1984 | Keeton | 112/121.12 X |

*Primary Examiner*—H. Hampton Hunter

*Attorney, Agent, or Firm*—John W. Harbst; John A. Schaerli

[57] ABSTRACT

The present invention concerns a guidance system operable in combination with an automatic transfer apparatus. The guidance system is effective to position each half of a folded and hemmed workpiece together in a proper orientation relative to each other and relative to a predetermined path during the time that the workpiece is removed from a first conveyor. The guidance system includes: a pair of workpiece hem aligners and hem guides.

3 Claims, 10 Drawing Figures

GUIDANCE SYSTEM FOR A WORKPIECE TRANSFER APPARATUS

This is a division of application Ser. No. 545,804 filed Oct. 26, 1983 and now abandoned.

FIELD OF THE INVENTION

This invention generally relates to a delivery system for textile articles or workpieces, and in particular, to a new and preferred device of this general class.

BACKGROUND OF THE INVENTION

Automation of the different phases in textile manufacturing is in great demand, particularly for the timely manipulation and transfer phases. From a manufacturer's viewpoint, automation is attractive in terms of labor and elimination of manual work. Automation also eliminates repetition which may make the manual tasks tedious.

Accordingly, in his patent application, Ser. No. 319,671, filed Nov. 9, 1981, now U.S. Pat. No. 4,428,315, John H. Keeton describes an automatic method and apparatus for assembling textile workpieces. More particularly, Mr. Keeton discloses an improved method for automatically making sleeves. In his application, Mr. Keeton describes a transfer apparatus for moving a textile workpiece from one conveyor to another. This is one of the key components in the patented apparatus to proper article manufacture. More particularly, the ability of the apparatus to correctly position the article on the second conveyor is very important. A continual problem has been the subsequent deposit of the workpiece on the second conveyor in a manner assuring the proper orientation of each half of the folded workpiece relative to each other and to a predetermined path.

SUMMARY OF THE INVENTION

With the above in mind, and in keeping with the present invention, there is provided a guidance system for a workpiece transfer apparatus which improves the performance of the machine described in the above-identified patent. The present invention finds utility with a conveyance system including a first conveyor means for moving a workpiece in a first direction and a second conveyance means arranged at the end of the first conveyance means for moving the workpiece in a seperate second direction. A work pick-up apparatus is disposed at the interface of the first and second conveyance means. The present invention is operated in timed relation with the work pick-up apparatus or transfer mechanism and effects the subsequent deposit of the folded and hemmed workpiece on the second conveyor such that each half of the hemmed workpiece is aligned with each other and relative to a predetermined path when so deposited.

The guidance system of this invention includes a series of component assemblies for effecting the desired result. The present invention includes a resiliently mounted guide means disposed above the conveyance means for engaging the sewn edge of the workpiece hem whereby controlling its lateral disposition. The guide means is so disposed to allow passage of one ply of material while urging the hemmed workpiece against a stationary guide. The present invention also provides a pair of hem alignment means. The first hem alignment means is disposed above the planar path of the first conveyance means. The first hem alignment means includes a reciprocal hem guide adapted to engage approximately one half of the length of the sewn edge of the workpiece hem. The guide means are operable in response to the movement of the transfer mechanism such that the hemmed workpiece is guided during the transfer process. The other hem alignment means is disposed for substantially vertically displacement along a reciprocal path. The second hem alignment guide includes means adapted to engage approximately the other half length of the sewn edge of the workpiece hem. The second guide means moves in timed relation to the movement of the transfer mechanism. The second hem alignment means also moves along a path which penetrates the generally horizontal direction of the first hem alignment means. The present invention also provides another reciprocal guide means adapted to limit the lateral displacement of the hemmed workpiece edge during the withdrawal movement of the workpiece. This later reciprocal guide means also operates in timed sequence with the movement of the workpiece transfer means. As an assembly, these various components serve to position each half of the folded and hemmed workpiece together in a proper orientation with each other and relative to a predetermined path. In this manner, the workpiece edges will be properly orientated when subsequently deposited on the second conveyor means whereby enhancing subsequent operations.

In line with all of the above, the primary object of this invention is the provision of a guidance system which is capable of positioning each half of a folded and hemmed workpiece together in a proper orientation with each other in relative a predetermined path which extends substantially coextensive with a stationary guide.

Another object of this invention is the provision of a guidance system for an automatic transfer apparatus which is simple in construction and efficient in operation.

BRIEF DESCRIPTION OF THE DRAWINGS

Having in mind the above objects and other attendent advantages that would be evident from an understanding of this disclosure, the invention comprises the devices, combinations, and arrangement of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
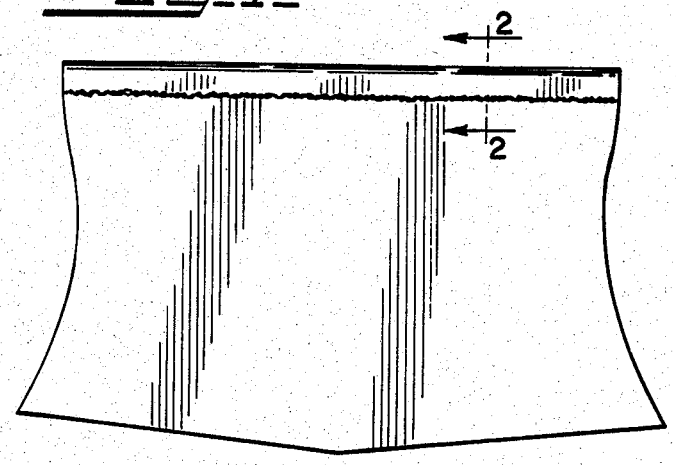
FIG. 1 is a top plan view of a hemmed sleeve blank.
Figure 7:
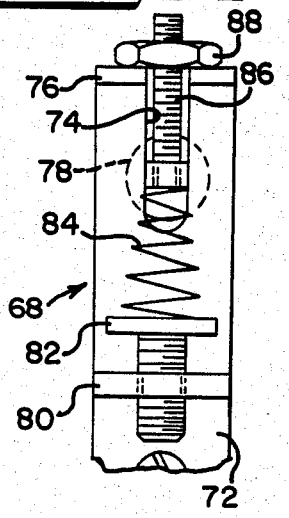
FIG. 7 is an enlarged front elevational view of a portion of the present invention.
Figure 2:
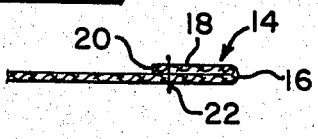
FIG. 2 is a sectional view taken along line 2—2 of FIG. 1.
Figure 3:
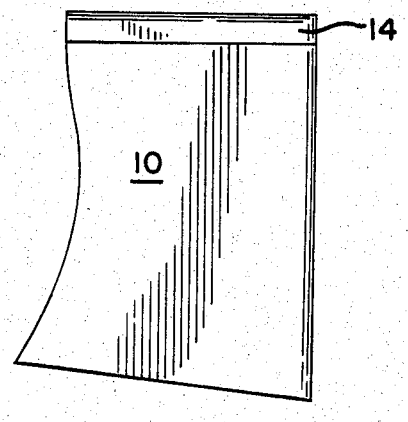
FIG. 3 is a top plan view of a folded and hemmed sleeve blank as it would appear when deposited on the second conveyor means of the present invention.

Turning now to the drawings, wherein like reference numerals indicate like parts througout the several views, a workpiece blank or article 10 is shown in FIG. 1. In the present operation, the blank 10 is fed through a hem forming station 12 whereat a fold or hem 14 is sewn in the lateral workpiece edge. Th schematic cross sectional representation of the sewn hem shown in FIG. 2 reveals that, upon leaving the hem forming station 12, the hemmed portion 14 of the workpiece comprises a double material ply fold 16 along the workpiece's lateral edge. The overlapping portion 18 of the workpiece is secured to the lowermost ply along its edge 20 with a series of stitches 22. Subsequent operations include: transferring the workpiece while concurrently folding same substantially in half about itself into a configuration substantially as schematically shown in FIG. 3.

Figure 4:
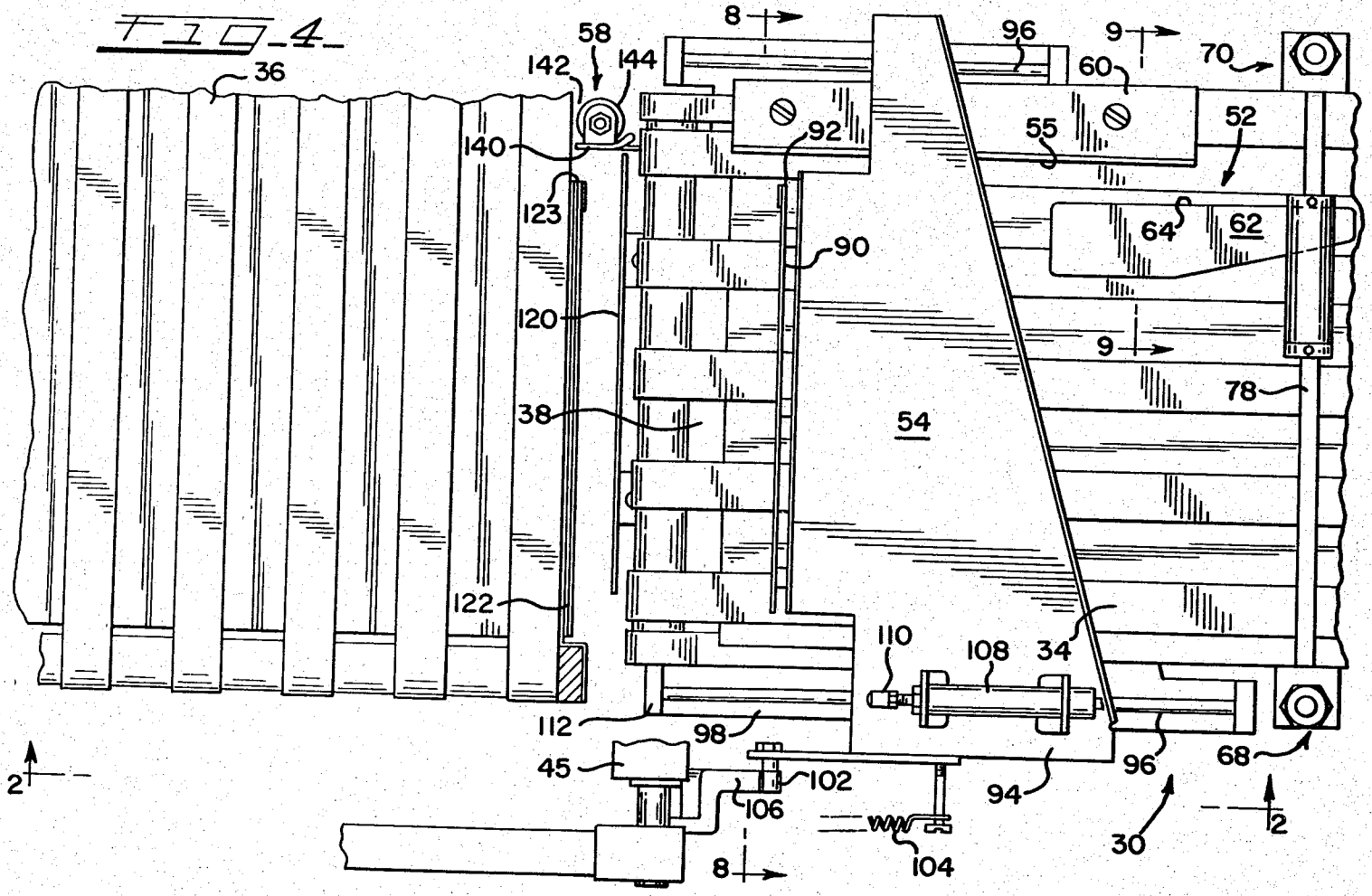
FIG. 4 is a partial top plan view of a delivery system including the present invention.
Figure 5:
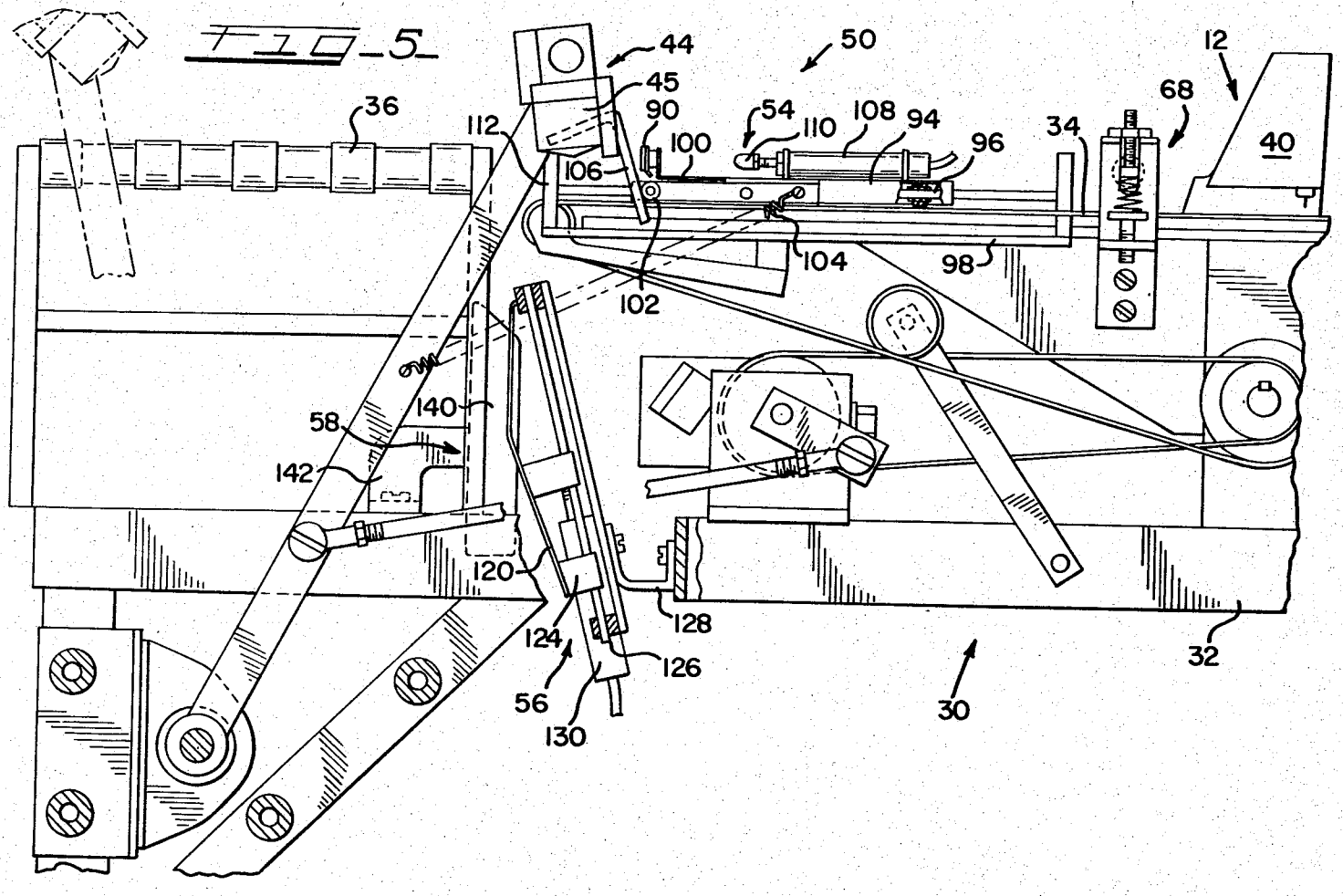
FIG. 5 is a partial side view of a delivery system encompassing the concepts of the present invention.
Figure 8:
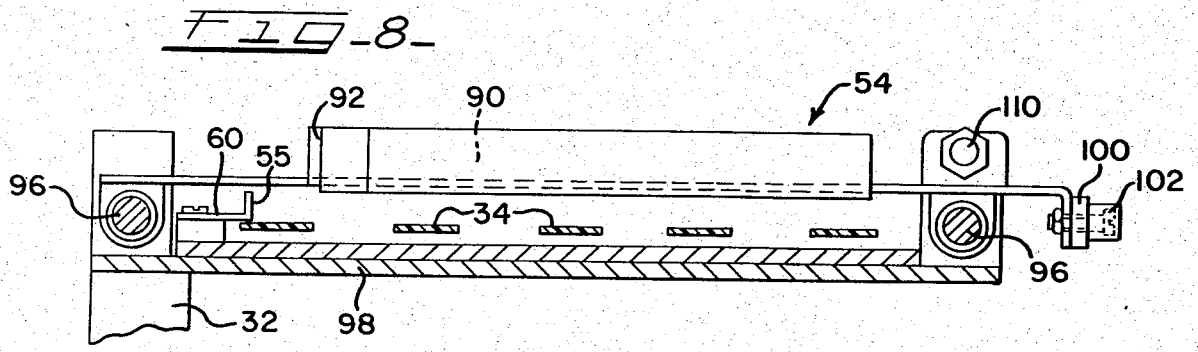
FIGS. 8 and 9 are section views along the lines 8–8 and 9–9 of FIG. 4.
Figure 9:
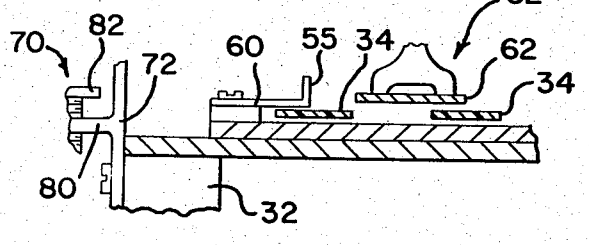
Figure 10:
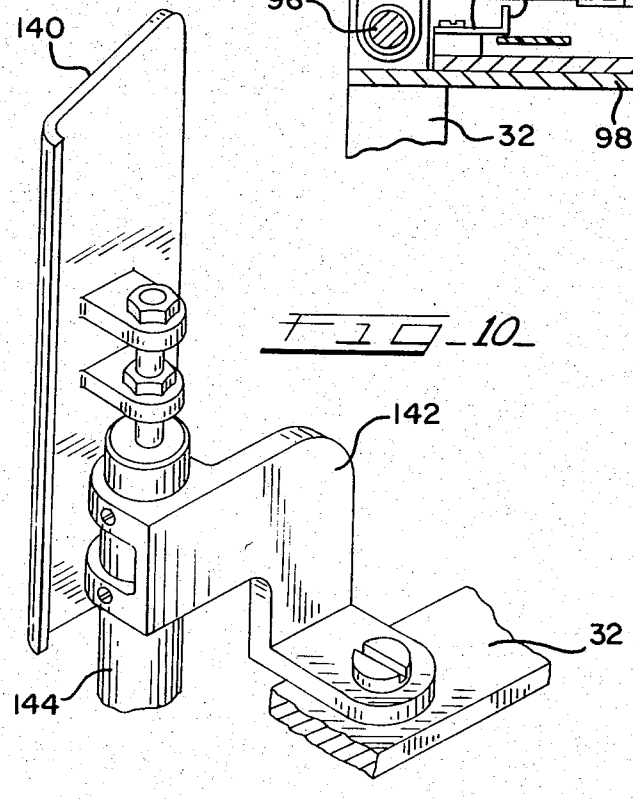
FIG. 10 is an enlarged partial view of the hem guide means.

The details of the exemplary apparatus for practicing or accomplishing the above described result—which apparatus may be used for other operation also—is illustrated in FIGS. 4 through 7. As seen in FIGS. 4 and 5, a material delivery system 30 is provided for moving the workpieces through the various stages or steps. The delivery system includes a generally L-shaped frame 32 each leg of which is provided with conveyance means 34 and 36. As is apparent from the drawings, the second conveyance means is arranged at the outlet end 38 of the first conveyance means. The conveyance means 34 moves the workpiece from an inlet end, whereat the workpiece blank is positioned on the conveyor to the outlet end or workpiece pick-up point 38. The conveyance means 34 defines a first elongated planar production path extending in a first generally horizontal direction. The second conveyance means 36 moves the workpiece along a second elongated planar production path extending in a second generally horizontal direction. Each conveyance means is adapted to sucessively move workpieces and comprises a series of laterally spaced endless belts which are continuously driven from a common drive means.

The hem forming station 12 is arranged adjacent or along the first production path. The hem forming station includes a sewing machine 40 and a folder mechanism (not shown). The folder mechanism may be of any conventional form which provides for folding the lateral edge of the workpieces to form a hem therein. The sewing machine may be of any suitable type, such as that sold by Union Special Corporation under Model No. 39500, and which is adapted to secure the fold or hem in the workpiece edge.

Once the workpiece exits the forming station, the hem is arranged under the rest of the cloth. For subsequent operations, it is desirable to move the hem back to a position as shown in FIG. 1, where it is substantially planar with the rest of the cloth. This may be accomplished through suitable means described in the above mentioned patent application Ser. No. 319,671 filed by John H. Keeton, the full disclosure of which is incorporated herein by reference.

To effect transferance of the workpiece from the workpiece pick-up point or outlet end 38 of the first conveyor means to the second conveyor, a workpiece transfer means 44 is provided. A suitable example of the preferred type of transfer means is that shown and described in U.S. patent application Ser. No. 505,571 filed by Mr. Robert L. Kosrow, et al on June 20, 1983. Suffice it to say, the workpiece transfer mechanism includes suitable workpiece gripper means 45 mounted for forward and backward movement toward and away from the workpiece pick-up point. In operation, the gripper means are automatically operated to engage the hemmed workpiece at a point midway along its hemmed length and then folds same about itself on its backward movement. Subsequently, the workpiece is released from the transfer means and deposited in a folded state (FIG. 3) on the second conveyance means.

To effect proper orientation of the folded and hemmed edges relative to each other and to a predetermined path during the removal of the workpiece from the first conveyance means and upon subsequent deposit on the second conveyance means, a material guidance system 50 is provided. The guidance system includes: hem guide means 52; first and second hem alignment means 54 and 56, respectively; and a hem guide means 58. The components comprising the guidance system of the present invention are proximately disposed at the interface of the first and second conveyance means.

The hem guide means 52 will first be described. The hem guide means 52 is disposed or supported above the first conveyance means 34 between the hem forming station 12 and the workpiece pick-up point 38. The guide means 52 is adapted to control the lateral disposition of the hem 14 relative to a stationary guide 55 secured to the frame of the machine. As best seen in FIG. 4, the hem guide means 52 includes a planar body 62 having a side edge 64 between which and the stationary guide the hemmed edge 14 of the workpiece is entrapped. The planar body 62 of the guide is so supported or arranged over the conveyance means such that only one ply of the workpiece may pass thereunder.

Preferably, the guide means 52 is resiliently supported above the conveyance means 34. The support means for accomplishing this result will now be described. Bracket or support means 68 and 70 are fixedly secured or disposed on either side of the conveyance means 34. Since both support means 68 and 70 are substantially the same, only the bracket means 68 as shown in detail in FIG. 7 will be described. The bracket means 68 includes a upwardly projecting body 72 secured to the frame 32. The bracket is provided with a vertically extending slot 74 therein and an outwardly projecting slotted arm 76 arranged at the top extreme thereof. One end of a suitably sized rod means 78 is arranged in the slot in a manner preventing rotation of the rod. As seen in FIG. 4, the support rod spans the distance across the conveyance means. From this rod 78, the planar body of the guide means is supported. Below the rod 78, the bracket 68 may be provided with another outwardly projecting arm 80 having a T-shaped member 82 threadably secured therein. The T-shaped member 82 is arranged for vertical adjustment relative to the projecting arm 80. Disposed between the upper end of the T-shaped member and the support rod 78 is a spring 84. Upwardly projecting from the other side of the rod 78 and beyond the other projecting arm 76 is a threaded member 86. Threadably engaged with member 86 is an adjustment nut 88 which is adapted to rest upon the upper projecting arm 76 of the bracket 68. As a skilled artesian may appreciate, the adjusting member 88, in combination with the resilient action of the spring 84, establishes the distance the support rod 78 and thereby the planar body 62 of the guide means is disposed above the conveyance means 34. Alternatively or additionally thereto, other forms of resilient support for the planar body, i.e. magnetic means, could be provided. By this construction, suitable and easy adjustment of the guide means may be accomplished to accommodate changes in various material thicknesses.

The hem alignment means 54 will now be discussed. The hem alignment means purpose is to influence or guide the disposition of the hemmed workpiece edge along approximately one half of the workpiece's hemmed length during the transferance process. The hemmed alignment means 54 includes a reciprocally arranged guiding member 90 that is interconnected with and responsive to the movements of the transfer apparatus 44. The guide means include a guiding edge 92 (FIG. 6) adapted to engage the sewn edge 20 of the hemmed workpiece whereby controlling its disposition. The guiding member 90 is carried on a reciprocal slide 94. The slide, in turn, is carried on a pair of guide rods 96 mounted on a base plate 98 secured to the frame 32 of the machine. Preferably, the slide 94 is adapted for generally horizontal reciprocation along a plane extending above but parallel with the planar path of the first conveyance means. Extending outwardly from the slide 94 is an arm 100 having a free turning roller means 102 arranged at the distal end thereof. A resilient member 104, such as a spring, is adapted to continually urge the roller means 102 into engagement with a cam member 106 carried by the transfer means 44. By such construction, the slide 94 and thereby the guiding member 90 is operatively interconnected with and lineraly moves in response to the movements of the workpiece pick-up means 44. The reciprocal movement of the guide means carries it such that the guide and slide are positionable over the workpiece pick-up point 38 during the transfer process. The slide 94 is further provided with a driver 108, preferably in the form of a pneumatic cylinder. The operative end 110 of the pneumatic cylinder is adapted to abut an upstanding leg 112 of a mounting or base plate 98 carried on the frame whereby limiting the horizontal movement of the slide and thereby the guide member in one horizontal direction. The movement of the transfer apparatus, and, more particularly, the engagement of the camming member 106 with the roller 102 controls the horizontal movement of the slide and guide member in the opposite horizontal direction.

The hem alignment means 56 will now be described. The purpose of the hem alignment means 56 is to influence or guide the disposition of the hemmed edge of the workpiece along the other half of the workpiece's hemmed length during the transfer process. By this process, the two hemmed edges may be aligned with respect to each other and relative a predetermined path extending substantially coextensive with the stationary guide means 60. The construction of the delivery system permits approximately one half of the hemmed workpiece's length (FIG. 2) to depend from the first conveyance means prior to removal or transferance of the workpiece to the second conveyor. The hem aligner 54 includes a reciprocally arranged member 120. The guiding member 120 combines with a guide plate 122 (FIG. 4) arranged on the second conveyance means for influencing the disposition of the hemmed workpiece edge relative a predetermined path. Like the guiding member 90, the guide plate 122 is provided with a guiding edge 123 (FIG. 6) that engages the sewn edge of the hemmed workpiece whereby controlling its disposition. The reciprocal member 120 is arranged on a slide 124. The slide, in turn, is carried by a pair of guide rods 126 mounted on a support plate 128. The support plate 128 is secured to the machine frame 32. The slide is generally vertically movable along a path which penetrates the planar direction of the first conveyance means. That is, in operation, the member 120 moves generally vertical to a point arranged above the planar path of the first conveyance means. The member 120 also has a horizontal component of movement whereby the depending workpiece portion is urged against the guide plate 122 by the member 120 and the hemmed edge is entrapped against the guiding edge 123. To effect this movement, the slide is provided with a driver 130, preferably in the form of a pneumatic cylinder. The driver is secured to the support means 128 and has its driving end connected to the slide 124. In operation, the slide is movable in timed relation with the movement of the transfer means 44.

The hem guide means 58 will now be described. The purpose of the hem guide means 58 is to limit the lateral displacement of the hemmed workpiece edge relative a predetermined path during the removal of the workpiece from the first conveyor means. To accomplish this result, the hemmed guide means 58 includes a guide member 140 whose lateral disposition is substantially coextensive with the lateral disposition of the stationary guide means 60. The hem guide means is provided with a support 142 that is secured to the frame 32 of the machine. The hem guide is reciprocal in a vertical direction in timed sequence with the movement of the transfer means and extends above the planar path of the first conveyance means. To accomplish this result, the drive member is operatively connected to a driver 144 (FIG. 4) which is preferably in the form of a pneumatic cylinder, which is carried by the support plate 142.

Figure 6:
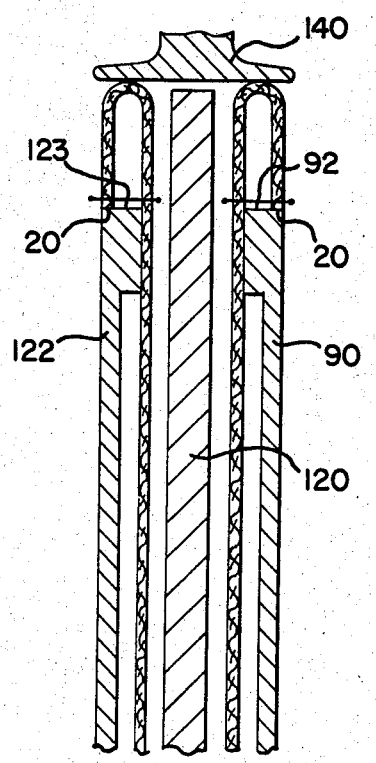
FIG. 6 is a sectional view showing the disposition of various components of the present invention at a particular time in the transferance cycle.

In operation, the lateral edge of the workpiece is moved along the first production path by the first conveyance means. While so traveling, the workpiece's lateral edge is folded and the resultant hem is secured to the workpiece by a series of stitches at the hem forming station 12. The hemmed workpiece's continued linear movement carries the workpiece to the hem guide means 52. At this point, the hem guide 62 engages the sewn edge 20 of the hem and laterally positions the hem 14 relative to the stationary guide 60. As the hemmed workpiece continues its linear travel, it eventually comes to the workpiece pick-up point or outlet end 38 of the first conveyance means. At such point, approximately one half of the hemmed workpiece length depends from the first conveyance means. Next, the tranfer apparatus engages the workpiece at a point midway along its hemmed length and substantially across the entire width of the article. The movement of the transfer means lifts the material workpiece whereby removing it from the first conveyor means. The movement of the transfer means also effects movement of the reciprocal slide 94 through the cooperative relationship of the camming member 106 and the roller means 102 whereby allowing the slide to move forward toward the workpiece pick-up point. The spring 104 causes the slide roller 102 to remain in engagement with the camming member 106 and to "track" the movement of the transfer means 44. Concurrently therewith, the driver 130 for the hem alignment means 56 receives a signal from the electronic circuitry of the apparatus whereby moving the guiding member 120 upwards in timed sequence with the movement of the transfer arm 44. At the same time, the driver 144 for the hem guide means 58 causes the guide member 140 to vertically move upwards. By this construction, the free edge of the hem is continually guided relative a predetermined point during the transferance process. As seen in FIG. 6, while the workpiece is being transfered from the first conveyor to the other conveyor, the guiding edge 92 of the hem alignment means 54 engages the sewn edge 20 of the hemmed workpiece approximately along one half of the hemmed articles workpiece length. The other guiding edge 121 on the guiding member 122 engages the sewn edge 20 of the hemmed workpiece along the other half of the hemmed article workpiece length. At the same time, the hem guide 140 of the hem guide means 58 controls the lateral disposition of the workpiece edge. In this manner, each half of the folded and hemmed workpiece edge is positioned relative to each other and to a predetermined path during the transferance process whereby assuring proper placement of the workpiece on the second conveyance means.

Prior to the release of the folded workpiece from the transferance means, the hem aligner means 54 and more particularly the guiding member 90 thereof is withdrawn from its engagement with the sewn edge of the hemmed workpiece. This is to avoid interferance with the placement of the folded article on the second conveyance means. To accomplish this end, the driver is energized prior to the time that the transferance means reaches its extreme rearward position. With the operative end of the driver already engaging the upstruck or upstanding leg 112 of the support means 98 as a result of the influence of the spring 104, the activation of the driver causes the slide to retract from its forwardmost position. Thus, the workpiece is released on the second conveyor with no interference from the hem alignment means 54. Similar timing may be incorporated in the design of the hem guide means 58.

Upon the return of the transferance means 44, the camming arm 106 forcibly and positively returns the slide 94 and thereby the guide member 90 to its initial position. The other hem alignment means 56 and the guide member 58 are also returned to their initial position for subsequent operation.

Thus, there has been provided, in accordance with the invention, a Guidance System for a Workpiece Transfer Apparatus that fully satisfies the objects, aims, and advantages set forth below. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described our invention, what we claim is:

1. The method of transferring a hemmed workpiece article having a sewn edge from one conveyor to another conveyor, comprising the steps of:

causing a pick-off means to engage the workpiece at a point midway along its hemmed length;

lifting the hemmed article from the conveyor such that the article folds in half about itself;

carrying the article to a point above the second conveyor; and positioning each half of the hemmed article in proper orientation relative to each other and a predetermined path during the carrying process.

2. The method recited in claim 1 wherein the positioning process includes the steps of:

engaging and guiding one half of the sewn edge of the hemmed article relative to a predetermined point during the carrying process; and engaging and guiding the other half of the sewn edge of the hemmed article relative to a predetermined point during the carrying process.

3. The method as recited in claim 1 further including the steps of guiding the lateral disposition of the hemmed workpiece edge relative a predetermined path during the carrying process.

* * * * *